US005427374A

United States Patent [19]

Ulloa et al.

[11] Patent Number: 5,427,374

[45] Date of Patent: Jun. 27, 1995

[54] HAND-HELD HAND-AGITATED PORTABLE RANDOM SELECTOR

[76] Inventors: Francisco Ulloa, 19 Ninth St., Richmond, Calif. 94801; Isidro Magallanes, 300 Moonraker Dr., Vallejo, Calif. 94590

[21] Appl. No.: 183,664

[22] Filed: Jan. 18, 1994

[51] Int. Cl.[6] ..... A63F 3/00

[52] U.S. Cl. ..... 273/144 B

[58] Field of Search ..... 273/144 R, 144 A, 144 B, 273/145 C

[56] References Cited

U.S. PATENT DOCUMENTS

| | | | |
|---|---|---|---|
| 4,732,387 | 3/1988 | Elinski | 273/144 A |
| 4,895,370 | 1/1990 | Kline | 273/144 B |
| 4,930,779 | 6/1990 | Maddox | 273/144 B |
| 5,050,882 | 9/1991 | Yang | 273/144 B |
| 5,102,138 | 4/1992 | Johnson | 273/144 B |
| 5,112,057 | 5/1992 | Popovic | 273/144 B X |

FOREIGN PATENT DOCUMENTS

| | | | |
|---|---|---|---|
| 2408181 | 7/1979 | France | 273/144 A |

*Primary Examiner*—William E. Stoll

*Attorney, Agent, or Firm*—Charles E. Townsend, Jr.

[57] ABSTRACT

An improved and simplified transparent hand-held random selector device used for selecting numbers, letters or symbols, or a combination of the three which are used for playing lottery related games or other games. Such device comprised of a container (10) formed by a ball mixing receptacle (11) a ball receiving receptacle (12) and a two position sliding gate (15) containing within a plurality of marked balls (19).

2 Claims, 3 Drawing Sheets

HAND-HELD HAND-AGITATED PORTABLE RANDOM SELECTOR

BACKGROUND OF THE INVENTION

This invention concerns a transparent improved and simplified hand-held hand-agitated portable random selector apparatus, consisting of a ball mixing receptacle, a two position sliding gate, a plurality of small solid spherical balls, each marked upon with numbers or letters or symbols or a combination of these three and a ball receiving receptacle.

The marked balls can be mixed randomly in the ball mixing receptacle by holding the apparatus in one hand and agitating it with any desired movement of said hand. The apparatus can be inverted to allow a predetermined number of said marked balls to fall through the predetermined number of circular holes of a two position sliding gate, when said sliding gate is at its open position and into a ball receiving receptacle through the circular holes of said ball receiving receptacle. The two position sliding gate can then be pushed to its closed position to capture and lock the selected balls within said ball receiving receptacle. The apparatus can then be turned and placed at any desired position in order to read the markings on said selected balls. Furthermore, this invention is directed to allow the user to carry it anywhere easily and comfortably.

BACKGROUND-DESCRIPTION OF PRIOR ART

There are several known random selectors in the art. Some of these known devices are present in U.S. Pat. Nos. 4,583,736, 4,616,831, 4,895,370, 4,930,779 and 4,978,125. While the above mentioned prior art devices are useful, there are some present disadvantages. These disadvantages are listed as follows: U.S. Pat. No. 4,978,125 requires the use of a fluid and a source of fluid pressure to operate and, furthermore, it employs a pair of extended tubular conduits protruding outward of the main container, thus, restricting its portability. U.S. Pat. No. 4,930,779 shows a device which provides no means to securely capture the selected balls, therefore, said balls can accidentally fall out of the through passage. U.S. Pat. No. 4,895,370 shows a device which uses a rotably container mounted on a support base that suggests the need for a resting surface to operate which restricts its portability. Furthermore, this device uses an actuator mechanism which employs a biasing element or spring in order to operate, thus, increasing the number of components used, and further still, this device employs a ball receiving housing consisting of individual square wall-enclosed chambers that limit somewhat the viewing of the numbers printed on the selected balls. Lastly, the manufacturing process involved in producing this said device is considerably complex.

OBJECTS AND ADVANTAGES

Accordingly, besides the objects and advantages of the hand-held hand-agitated portable random selector described before, several objects and advantages of the present invention are:

(a) To provide a random selector that is completely operable by using a single hand.

(b) To provide a random selector that enables the user to hold the device at any desired position using a single hand, to permit the reading of the markings on the selected balls comfortably, while securely keeping said balls within the ball receiving receptacle.

(c) To provide a random selector that allows the user to thoroughly mix the plurality of marked balls contained within the ball mixing receptacle, using any desired movement of a single hand.

(d) To provide a random selector that employs a simple two position sliding gate perforated with a predetermined number of circular holes used to select, lock and release a predetermined number of marked balls.

(e) To provide a random selector that employs a two position sliding gate which can be operated using a single finger of the same hand that holds it, allowing the use of the other hand to record the markings on the selected balls.

(f) To provide a random selector which can easily fit in the user's one hand, thus, enhancing its portability.

(g) To provide a random selector that incorporates the use of a tubular dome shaped like ball receiving receptacle, to receive and contain within a predetermined number of marked balls, in which said balls are kept apart by using small semi-circular bumper like separators to maintain said balls within each of their designated spaces, instead of using enclosing walls, thus obtaining more mobility and visibility for clearer viewing of the markings of said balls and also minimizing the manufacturing process.

(h) To provide a random selector that employs a minimum of component parts to fully achieve its intended purpose.

(i) To provide a random selector that selects a predetermined number of marked balls simultaneously.

(j) To provide a random selector which is transparent and is made of readily available materials.

Still, further objects and advantages will become apparent from a consideration of the ensuing description and drawings.

SUMMARY OF THE INVENTION

The present invention, a hand-held hand-agitated portable random selector, comprises a container formed by a ball mixing receptacle, and a ball receiving receptacle, coupled together, containing a plurality of marked small balls and a two position sliding gate which is freely located between the two said receptacles and when positioned at its first position, will allow a predetermined number of said plurality of balls to pass through from the ball mixing receptacle into the ball receiving receptacle, and when it is pushed to its second position,it will capture and lock the predetermined number of balls, now selected, within said ball receiving receptacle for vi-ewing. Said sliding gate can then be pushed back to its first position to allow the selected balls to fall back into said ball mixing receptacle. This process can be repeated to obtain additional selections. The markings on the selected balls can be used for playing lottery related games such as LOTTO, DECCO, DAILY THREE, KENO, etc. or other amusement games.

Figure 1:
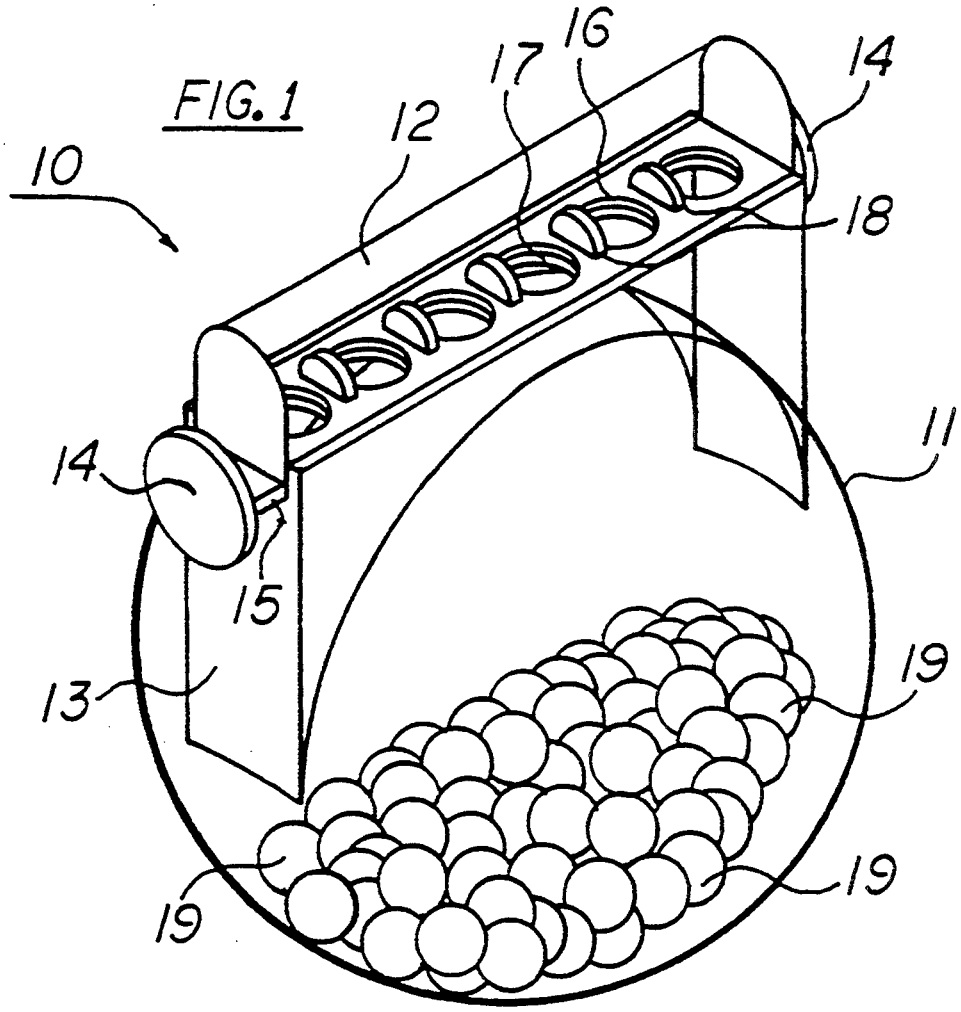
FIG. 1 is a perspective view of the random selecting device of the present invention.

10 preferred embodiment
11 ball mixing receptacle
12 ball receiving receptacle
13 extended rectangular aperture
14 finger pushers and stoppers
15 two position sliding gate
16 receiving receptacle's circular holes
17 sliding gate's circular holes
18 semi-circular bumper spacers
19 plurality of spherical balls
20 viewing enhancing circles
21 ball markings options
30 alternate embodiment Operation FIGS. 1 through 7

The random selector in the present invention is structured for fast and simple operation using a single hand. The apparatus 10 is held in one hand, the sliding gate 15 is pushed to its open position with a finger of the same hand that holds it. The plurality of balls 19 are mixed by agitating the apparatus 10 with any desired movement of said hand. The apparatus 10 is then inverted to allow the predetermined number of balls 19 to fall into the ball receiving receptacle 12. The sliding gate 12 is pushed to its closed position with said finger to secure and capture the selected balls 19. The apparatus 10 can then be placed at any desired position to view and record the markings 21 on the selected balls 19. The sliding gate 15 is then pushed to the open position to release the selected balls 19 back into the ball mixing receptacle 11.

The process can be repeated over to obtain additional selections.

DETAILED DESCRIPTION OF THE INVENTION

As shown in FIGS. 1 through 7, the present invention is described as an apparatus made of transparent materials, even though a combination of other readily available materials can be used without impairing its intended purpose and objectives.

FIG. 1 shows the apparatus generally at 10 which is comprised of four main components, a globe shaped ball mixing receptacle 11 with its extended rectangular aperture 13 the plurality of small marked balls 19, the two position sliding gate 15 and the tubular dome shaped like ball receiving receptacle 12. The marked balls 19 are generally contained within the ball mixing receptacle 11 for the purpose of random mixing.

The extended rectangular aperture 13 which is an integral member of the ball mixing receptacle 11 extends outward and terminates in a rectangular aperture which serves as a passage for the balls 19 to the ball receiving receptacle 12, and is dimensioned and shaped to accommodate within the sliding gate 15 and the ball receiving receptacle 12.

The sliding gate 15 is of a planar rectangular shape and is perforated with a predetermined number of circular holes 17 of a diameter slightly larger than that of the small balls 19 permitting the through passage of said balls 19 from the ball mixing receptacle 11 to the ball receiving receptacle 12 and vice versa. Two round finger pushers and stoppers 14 are fixed perpendicularly to each end of the sliding gate 15 to control the travelling distance of said sliding gate 15 when it is pushed either one of its two positions and also provides two surfaces for placing a finger to push it. The sliding gate 15 is freely fitted within the two longer walls at the terminating end of the extended aperture 13 and it is dimensioned to exactly line up its perforated circular holes 17 with the circular holes 16 of the receiving receptacle 12 when it is pushed to its open position, and when it is pushed to its closed position, it will no longer line up thus offsetting the alignment of said circular holes 16 and 17 to block the passage of any of the marked balls 19 in either direction. The ball receiving receptacle 12 is of tubular dome-like shape with one planar surface perforated with a predetermined number of circular holes 16 of the exact number, diameter and location of those of the circular holes 17 of the sliding gate 12. The ball receiving receptacle 12 is dimensioned to fit and to be permanently affixed within the two longer walls of the extended aperture 13 overlapping the sliding gate 15, providing at the same time the precise spacing for the sliding gate 15 to fit inbetween and to slide freely but tight enough to maintain pressure onto said sliding gate 15 to move only when force is applied to keep a stationary position and preventing it from accidentally sliding when viewing. The receiving receptacle 12 is dimensioned to house within and to allow free rotating movement of the selected marked balls 19 to place the markings at a better viewing position. The receiving receptacle 12 contains semi-circular bumpers 18 positioned inside on its planar surface between the perforated circular holes 16 in order to securely keep each of the selected marked balls 19 within their designated spaces.

Figure 2:
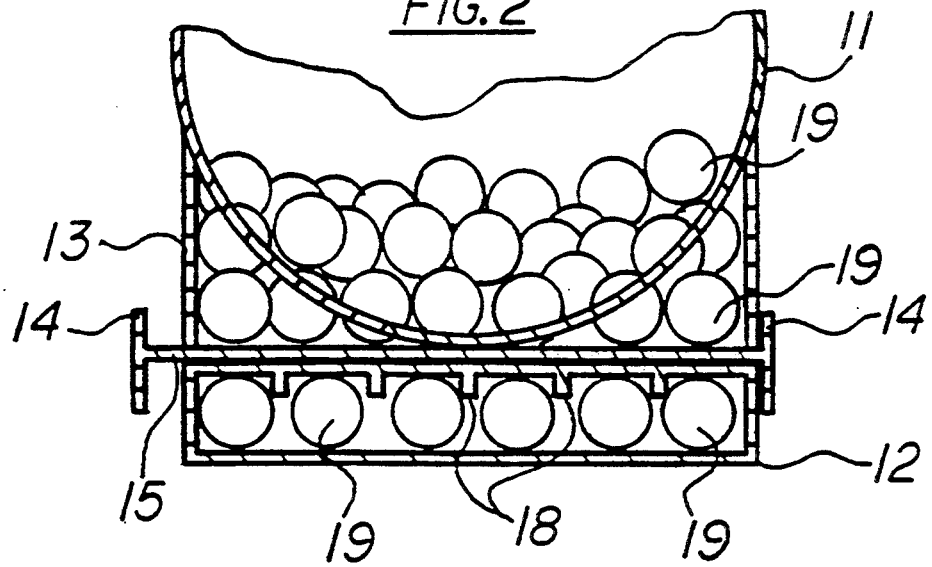
FIG. 2 is a cutaway view showing the two receptacles, a plurality of small balls and the two position sliding gate placed at its open position.

Referring now to FIG. 2, an inverted cutaway view of the present invention, it shows the precise locations of the structural components and their functional relationship. The ball mixing receptacle 11, the extended rectangular aperture 13 a plurality of balls 19, the sliding gate 15 at one of its two positions and the two perpendicularly positioned finger pusher-stoppers 14 and the ball receiving receptacle 12 with the bumper spacers 18 containing within a predetermined number of the plurality of balls 19.

Figure 3:
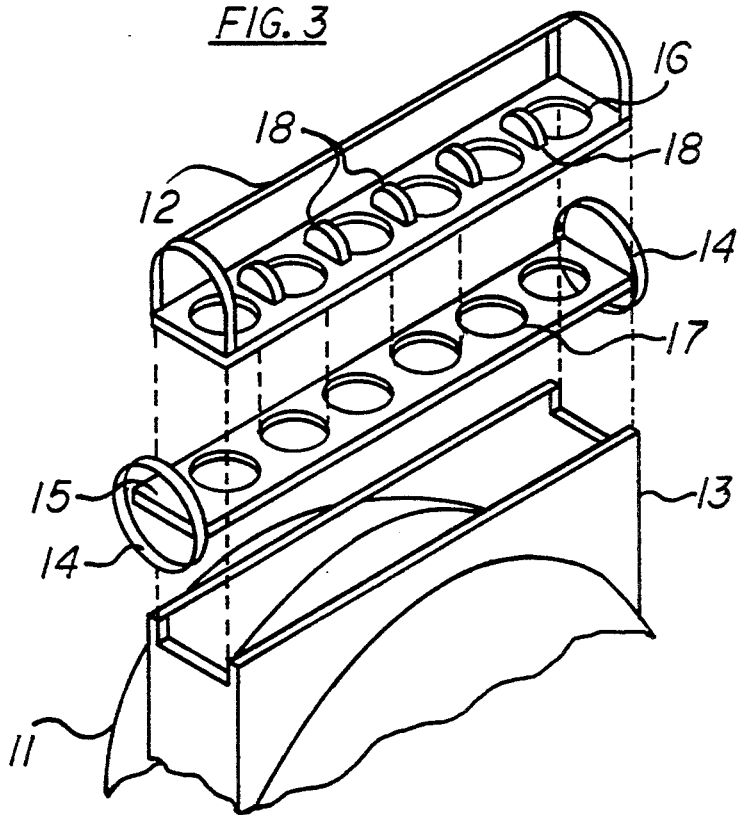
FIG. 3 is an exploded isometric view of the two receptacles and the two position sliding gate illustrating their locations and their functional relationship.

The isometric exploded view in FIG. 3 shows the extended rectangular aperture 13 providing through passage for the plurality of balls to reach the sliding gate 15 and also illustrates in clear detail the necessary structural provisions for the sliding gate 15 and the receiving receptacle 12 to be fitted within said aperture. Furthermore, it shows clearly the exact aligning of the circular holes 16 and the circular holes 17.

Figure 4:
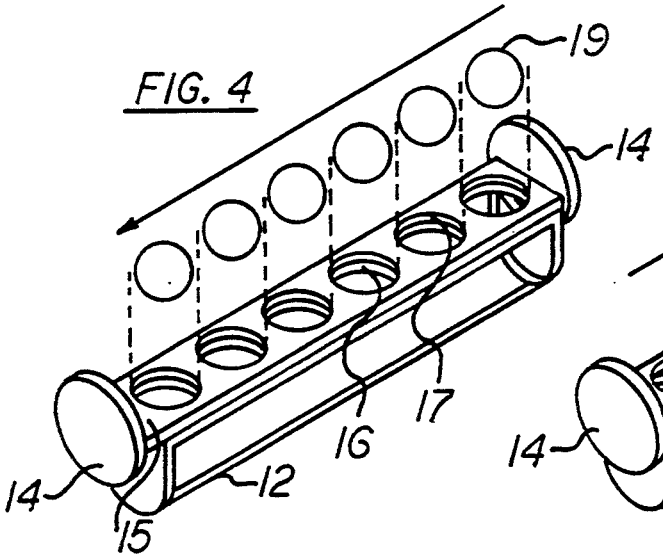
FIG. 4 is an isometric view of the two position sliding gate at its open position, the ball receiving receptacle and a predetermined number of balls to further illustrate more specifically their locations and their structural relationship.

As seen in FIG. 4, the partial inverted isometric view shows the sliding gate 15 at its closed position, which allows its perforated holes 17 to line up exactly with the perforated holes 16 of the ball receiving receptacle 12, permitting the passage of a predetermined number of the plurality of the balls 19 simultaneously.

Figure 5:
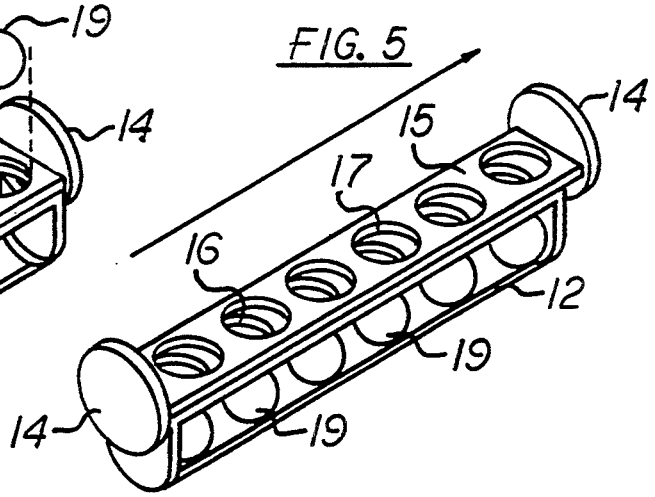
FIG. 5 is an isometric view similar to FIG. 4 showing the two position sliding gate at its closed position and the ball receiving receptacle housing within a predetermined number of selected balls.

As seen in FIG. 5, the partial inverted isometric view shows the sliding gate 15 at its closed position and a predetermined number of the plurality of balls 19 captured within the ball receiving receptacle 12. When said sliding gate 15 is placed at its closed position, the holes 16 and 17 will no longer line up with each other, thus blocking the passage of the selected balls in either direction.

Figure 6:
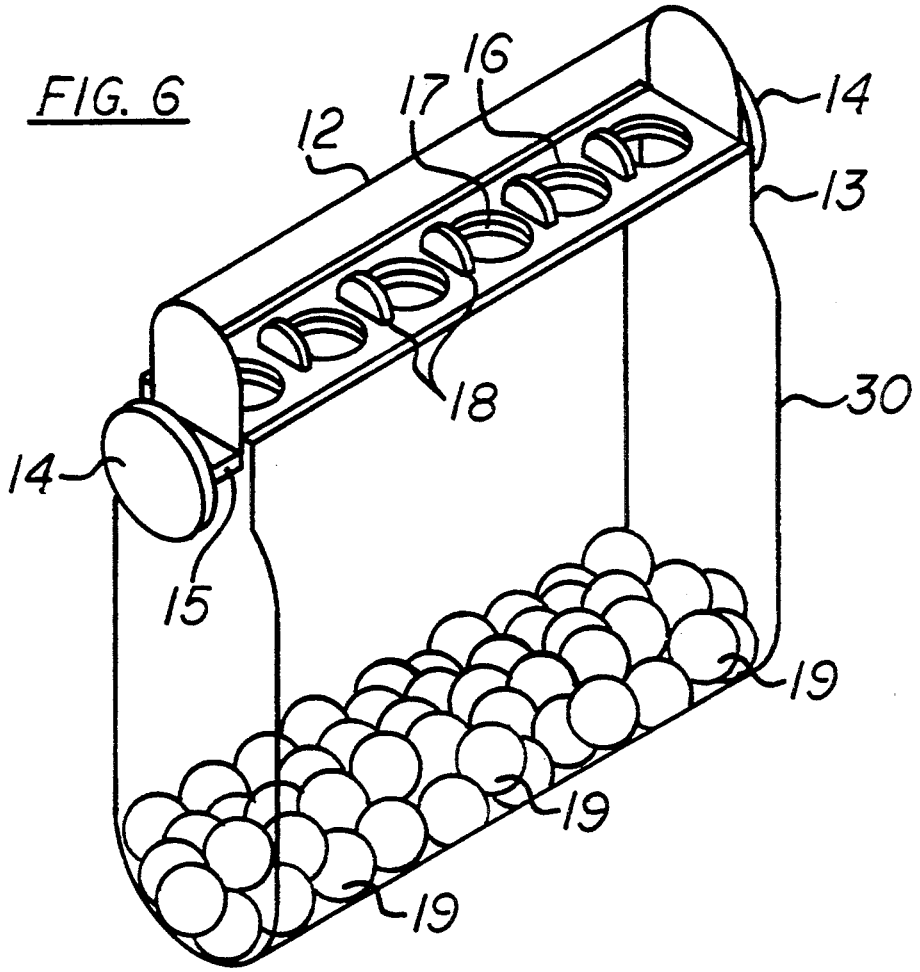
FIG. 6 is a perspective view of one of the alternate embodiments of the ball mixing receptacle.

FIG. 6 illustrates one of the several alternate configurations possible. It is to be observed that the changes made affect only the ball mixing receptacle 30 without alterating any of the remaining components of the present invention, thus minimizing the amount of additional re-tooling. The unchanged remaining components are: the ball receiving receptacle 12, the two position sliding gate 15 and the plurality of balls 19.

Figure 7:
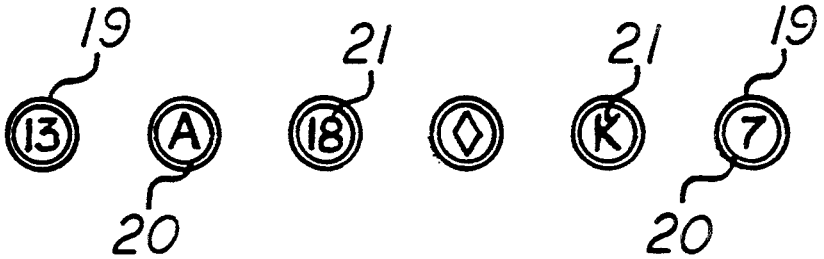
FIG. 7 is a front view of the balls and optional encircled markings Reference Numerals in Drawings

FIG. 7 specifically illustrates a portion of the plurality of balls 19 which are all spherically shaped solid members of equal diameters, bearing upon their surface two of the same markings 21 selected for any specific game, printed twice on opposite sides of said balls 19, said markings placed within a printed circle to assist the user to view said markings easier.

We claim:

1. A hand-held hand-agitated portable random selector to select numbers, letters, symbols or a combination of said three for use in playing a variety of lottery related games or other amusement games comprising:

a plurality of differently marked balls of uniform diameter;

a hollow globe defining a ball mixing receptacle and formed with an elongate rectangular aperture of slightly larger width said uniform ball diameter;

an elongate, trough-like rectangular in cross-section open top ball receiving receptacle made of transparent material and having a width and height only slightly larger than the said uniform ball diameter and a length sufficient to accommodate a preselected number of balls in preselected spaced relationship to one another;

the open top of the ball receiving receptacle being of the same size and disposed in registry with the rectangular aperture formed in the globe;

sliding gate means interposed between said rectangular aperture formed in said globe and the rectangular open top of said ball receiving receptacle operable to permit simultaneous passage of a preselected number of balls into the ball receiving chamber for viewing;

said gate means comprising a first fixed plate overlying the open top of the ball receiving receptacle, and a second plate overlying said first plate and mounted for slidable longitudinal back and forth movement relative to said first plate;

each plate formed with a preselected number of round holes of uniform diameter only slightly larger than the uniform diameter of said balls, said holes uniformly spaced apart from one another the same amount as the aforesaid preselected uniform spacing between balls released into said receiving receptacle from the mixing receptacle through actuation of the gate means;

the holes in said first plate being slidably movable into registry with the holes in the second plate to simultaneously release a plurality of balls from the mixing chamber into the ball receiving chamber;

a plurality of transverse uniformly spaced bumper elements affixed to the underside of said first plate and having portions thereof depending downwardly into only the upper central regions of said receiving receptacle;

each bumper element affixed to the underside of said first plate in an unperforated solid area between adjacent round holes in said first plate, whereby the uniformly spaced bumper elements keep the balls uniformly and preselectively spaced apart for viewing in said receiving receptacle.

2. The combination of claim 1 and wherein said transverse depending bumper elements are semi-circular in shape.

* * * * *